US008548191B2

(12) United States Patent
Stead

(10) Patent No.: US 8,548,191 B2
(45) Date of Patent: Oct. 1, 2013

(54) LOUDSPEAKER MAGNET HAVING A CHANNEL

(75) Inventor: Brendon Stead, Encinitas, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 2 days.

(21) Appl. No.: 13/443,783

(22) Filed: Apr. 10, 2012

(65) Prior Publication Data

US 2012/0263336 A1 Oct. 18, 2012

Related U.S. Application Data

(60) Provisional application No. 61/474,555, filed on Apr. 12, 2011, provisional application No. 61/474,527, filed on Apr. 12, 2011, provisional application No. 61/474,611, filed on Apr. 12, 2011, provisional application No. 61/474,592, filed on Apr. 12, 2011.

(51) Int. Cl.
*H04R 25/00* (2006.01)

(52) U.S. Cl.
USPC ..... 381/421; 381/396; 381/412

(58) Field of Classification Search
USPC ..... 381/396, 400, 412, 414, 421
See application file for complete search history.

(56) References Cited

U.S. PATENT DOCUMENTS

| | | | |
|---|---|---|---|
| 4,752,963 | A | 6/1988 | Yamazaki et al. |
| 6,222,931 | B1 | 4/2001 | Cesati |
| 2009/0028375 | A1 | 1/2009 | Richoux et al. |

FOREIGN PATENT DOCUMENTS

| | | | |
|---|---|---|---|
| EP | 1229759 | A1 | 8/2002 |
| EP | 1843628 | A1 | 10/2007 |
| EP | 2262281 | A1 | 12/2010 |
| JP | 56-027600 | | 3/1981 |
| JP | 56-063193 | | 5/1981 |
| JP | 03-240399 | | 10/1991 |
| WO | WO 2009/046682 | A1 | 4/2009 |

OTHER PUBLICATIONS

European Search Report for corresponding Application No. 12163878.7, mailed Jul. 20, 2012, 7 pages.

*Primary Examiner* — Suhan Ni

(74) *Attorney, Agent, or Firm* — Brooks Kushman P.C.

(57) ABSTRACT

A transducer magnet for a low profile loudspeaker transducer is provided having a voice coil, surround suspension, diaphragm, and top plate. The transducer magnet may include a first magnet assembly, including an annular outer magnet having an outer perimeter, an outer diameter and an inner diameter. The inner diameter defines a vacant circular center within the annular outer magnet, and the difference in length between the diameter of the circular inner magnet and the inner diameter of annular outer magnet define an annular first magnet assembly air gap. The annular outer magnet includes one or more channels extending inwardly from the outer perimeter of the annular outer magnet to the first magnet assembly air gap, which is configured to receive the voice coil. The channels are configured to pass hookup wires from the voice coil to an external device from the transducer magnet.

8 Claims, 15 Drawing Sheets

LOUDSPEAKER MAGNET HAVING A CHANNEL

CROSS-REFERENCE TO RELATED APPLICATIONS

This application claims priority to U.S. provisional patent applications Ser. No. 61/474,555, filed Apr. 12, 2011, titled "LOUDSPEAKER MAGNET ASSEMBLY;" Ser. No. 61/474,527, filed Apr. 12, 2011, titled "CHANNEL MAGNET ASSEMBLY;" No. 61/474,611, filed Apr. 12, 2011, titled "LOW PROFILE LOUDSPEAKER WITH REINFORCED DIAPHRAGM;" Ser. No. 61/474,592, filed Apr. 12, 2011, titled "LOW PROFILE LOUDSPEAKER SUSPENSION SYSTEM," all of which are incorporated by reference in this application in their entirety.

BACKGROUND OF THE INVENTION

1. Field of the Invention

This invention relates to loudspeaker transducers, and in particular, the configuration of a loudspeaker magnet having a channel within a loudspeaker transducer.

2. Related Art

Sound reproduction devices such as loudspeakers are utilized in a broad range of applications in many distinct fields of technology, including both the consumer and industrial fields. Generally, loudspeakers consist of one or more driver units in a box. These driver units are typically known as "loudspeaker drivers," "drivers," "loudspeaker transducer," or "transducers." Loudspeaker transducers utilize a combination of mechanical and electrical components to convert electrical signals (representative of the sound) into mechanical energy that produces sound waves in an ambient sound field corresponding to the electrical signals. The variations of electric energy are converted into corresponding variations of acoustic energy (i.e., sound waves) by rapidly vibrating a flexible diaphragm within the transducer.

Loudspeakers transducers are generally of two common construction types. The first construction type is a conventional dual-suspension driver construction where the diaphragm of the loudspeaker transducer is formed as a cone and is substantially greater in diameter than the voice coil. As an example, in FIGS. 1A and 1B, a typical known dual-suspension loudspeaker transducer 100 is shown. FIG. 1A shows a perspective view of the known loudspeaker transducer 100 and FIG. 1B shows a cross-section view of the known loudspeaker transducer 100. The loudspeaker transducer 100 shown is an example of an implementation of a moving coil electrodynamic piston driver commonly also known as a "dynamic loudspeaker." The known loudspeaker transducer 100 may include a diaphragm 102, frame 104, surround 106, front plate 108, magnet 110, back plate 112, voice coil 114, former 116, center pole 118, vent 120, gap 122, spider 124, and optional dust cap 126.

In this example, the loudspeaker transducer 100 consists of the diaphragm 102 (also known as a "cone") attached to the frame 104 (also known as a "basket") via the surround 106. Attached to the rear end of the diaphragm 102 is a coil of wire (known as the voice coil 114) that is wound around a cylindrical extension of the diaphragm 102 that is known as the former 116. It is appreciated by those skilled in the art that in practice, the combination of both the voice coil 114 and former 116 may also be referred to as simply the "voice coil." The former 116 is connected to the frame 104 via the spider 124. The combination of the surround 106 and spider 124 form a suspension system for the diaphragm 102. Both the spider 124 and the surround 106 generally act as a rim, made of flexible material that spans between the former 122 and the frame 104 and the diaphragm 102 and the frame 104, respectively. The suspension system acts to provide the stiffness of the diaphragm 102 and also provide air sealing for the transducer 100. The configuration of the voice coil 114, former 122, and diaphragm 102 in the frame 104 via the suspension system depends generally upon the design and size of the diaphragm 102 relative to the voice coil 114 and former 122. In an example of operation, the diaphragm 102 acts as a piston to pump air and create sound waves.

The loudspeaker transducer 100 also consists of the magnet 110, front plate 108, back plate 112, and center pole 118 (also known as a "pole piece"). The front plate 108, back plate 112, and center pole 118 are usually made of iron, steel, or a similar permeable material to form a magnetic circuit with the magnet 110, which is generally a permanent magnet. Typically, both the front plate 108 and back plate 112 are ring shaped. The magnet 110 is cylindrically ring shaped and the center pole 118 is a hollow cylinder that is located within the magnet 110 and extends between the front plate 108 and back plate 112. The center pole 118 has a lip at end that extends to the front plate 108 that is approximately perpendicular to center pole 118. The lip extends outward from the center pole 118 to the front plate 108 to form the gap 122. Generally, the front plate 108 and center pole 118 form the circular gap 122 of the magnetic circuit. The voice coil 114 and former 116 are then suspended within the gap 122 and spider 124 acts to center the former 116 and voice coil 114 within the gap 122 while also allowing former 116 and voice coil 114 to move freely back forth within the gap 122. The center pole 118 may include an optional cylindrical vent 120 that to prevent pressure from building behind the diaphragm 102 in the magnetic assembly and to provide for cooling of the voice coil 114. If the vent 120 is present, the optional dust cap 126 (also known as a "screen") may also be present to prevent debris from entering through the vent 120.

In an example of operation, when an electrical signal from an amplifier passes through the voice coil 114, the voice coil 114 and former 122 turn into an electromagnet. Depending on which way the current is travelling in the voice coil 114, the north and south pole of the magnetic field, created by the voice coil 114, will be at one end of the voice coil 114 or the other. The magnet 110 has a north and south pole as well and its magnetic field will push the voice coil 114 (and the attached diaphragm 102) outward if the north and south poles of the two magnetic fields are lined up together (north-to-north and south-to-south) or pull the voice coil 114 inward if they are lined up oppositely (north-to-south and south-to-north).

The second type of driver construction is an edge-driven-diaphragm driver. In this construction, the diaphragm and the voice coil are of substantially equal diameter. The outer edge of the diaphragm is then attached to the diaphragm to form a diaphragm assembly. This assembly is then attached to the voice coil. The surround suspension assembly extends outward to connect the assembly to the frame. This edge-driven-diaphragm driver construction is often found in smaller speaker assemblies, such as tweeters, and sometimes in mid-range speakers. An example of edge-driven-diaphragm driver is described in U.S. Pat. No. 7,167,573, titled "FULL RANGE LOUDSPEAKER," issued on Jan. 23, 2007 to inventor Clayton C. Williamson, which is hereby incorporated by reference in its entirety.

One common problem with smaller sized loudspeakers is as the size of the loudspeakers becomes smaller, achieving acceptable low frequency response becomes more difficult.

This is because the loudspeaker is required to displace a larger volume of air to achieve the lower frequencies, and the suspension stiffness must be reduced to maintain a low resonance corresponding to the lighter mass of the smaller driver. The volume of air that a loudspeaker can displace is dependent upon the area of the diaphragm and the range of motion allowed by the suspension, i.e., amount of vibrational excursion, or volume displacement; of the loudspeaker. Additionally, higher suspension stiffness acts to reduce the motion of the diaphragm for a given input, so a minimum of stiffness is desired. Since smaller loudspeakers have a smaller diaphragm and stiffer suspension, the volume displacement, and thus the performance, is limited by the ability to manufacture loudspeakers with very low stiffness and high excursion capabilities.

To operate efficiently, the suspension system in smaller loudspeakers, such as those found in edge-driven diaphragm speakers, must allow a required maximum amplitude of vibration while constraining the vibrational movement essentially to a straight-line path to avoid the voice coil contacting the surrounding structure. Thus, the surround suspension member is required to constrain the diaphragm against any tilting, rocking or other extraneous vibration while allowing maximum possible amplitude of desired vibration. A general problem with the current construction of edge-driven speakers is the difficulty of precisely aligning the components during manufacturing, as the magnetic air gap is shielded by the diaphragm. This forces the removal of all alignment gauges prior to the placement of the diaphragm/coil assembly, and thus causes uncertainty in location of the voice coil relative to the motor. This is commonly known as a "blind" assembly.

An additional general problem with the current construction of loudspeakers is that spurious vibration of portions of the surround suspension members occur at high audio frequencies. These spurious vibrations may be transmitted to the diaphragm through the suspension, thereby degrading the high frequency performance of the speakers. Also, with the current loudspeaker construction, the maximum amplitude of vibration is limited in smaller sized loudspeakers, preventing low frequency responses from the smaller diameter speakers. Furthermore, the frame construction of even smaller sized loudspeakers prevents these loudspeakers from being thin enough for use in laptops and to electronic tablet devices.

A need therefore exists for a loudspeaker construction that minimizes the effect of the spurious vibration of the suspension system on the diaphragm, increases the amount of excursion of the voice coil/diaphragm assembly to provide low frequency response in smaller diameter loudspeaker systems, and has a low profile suitable for use in laptops, electronic tablet, and other low profile devices.

SUMMARY

A transducer magnet for a low profile loudspeaker transducer having a voice coil, surround suspension member, diaphragm, and top plate is shown. The transducer magnet may include a first magnet assembly. The first magnet assembly may include an annular outer magnet having an outer perimeter, an outer diameter and an inner diameter. The inner diameter defines a vacant circular center within the annular outer magnet and the difference in length between the diameter of the circular inner magnet and the inner diameter of annular outer magnet define an annular first magnet assembly air gap. The annular outer magnet includes one or more channels extending inwardly from the outer perimeter of the annular outer magnet to the first magnet assembly air gap, and the first magnet assembly air gap is configured to receive the voice coil and the channels are configured to pass hookup wires from the voice coil to an external device from the transducer magnet.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1B:
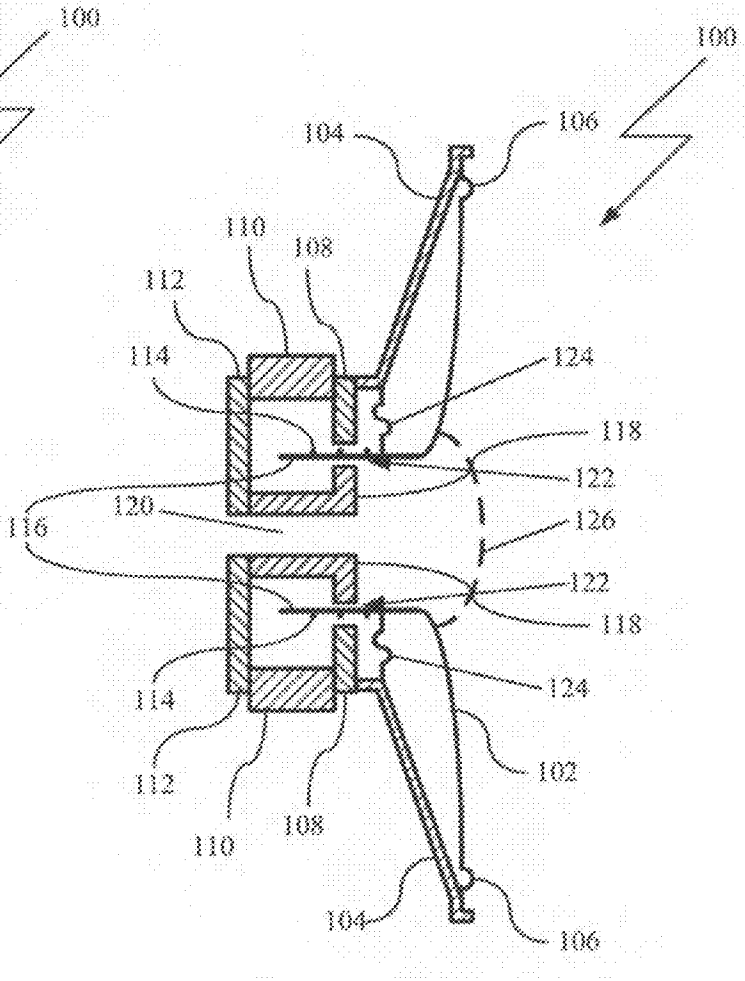
FIG. 1B (Prior Art)
FIG. 1B is a cross-sectional view of the known loudspeaker transducer shown in FIG. 1A.

In order to solve the problems in the prior art, a loudspeaker magnet assembly for a loudspeaker transducer having a voice coil is provided that has a low profile construction in accordance with the invention. The loudspeaker magnet assembly may include: a first magnet assembly; top plate positioned below the first magnet assembly; second magnet assembly positioned below the top plate; and bottom plate positioned below the second magnet assembly.

The first magnet assembly may include an annular outer magnet and a circular inner magnet. The annular outer magnet has an outer diameter and an inner diameter, where the inner diameter defines a vacant circular center within the annular outer magnet. The circular inner magnet has a diameter less than the inner diameter of the annular outer magnet and is positioned concentrically within the vacant circular center of the annular outer magnet. The difference in length between the diameter of the circular inner magnet and the inner diameter of annular outer magnet define an annular first magnet assembly air gap.

The top plate may include an annular outer top plate and a circular inner top plate. The annular outer top plate has an outer diameter and an inner diameter, where the inner diameter defines a vacant circular center within the annular outer top plate. The circular inner top plate has a diameter less than the inner diameter of the annular outer top plate and is positioned concentrically within the vacant circular center of the annular outer top plate. The difference in length between the diameter of the circular inner top plate and the inner diameter of annular outer top plate define an annular top plate air gap.

The second magnet assembly may include an annular outer magnet and a circular inner magnet. The annular outer magnet has an outer diameter and an inner diameter, where the inner diameter defines a vacant circular center within the annular outer magnet. The circular inner magnet has a diameter less than the inner diameter of the annular outer magnet and is positioned concentrically within the vacant circular center of the annular outer magnet. The difference in length between the diameter of the circular inner magnet and the inner diameter of annular outer magnet define an annular second magnet assembly air gap.

The diameter of the circular inner magnet, of the first magnet assembly, coincides with the diameters of the circular inner top plate and circular inner magnet of the second magnet assembly, such that the first magnet assembly air gap, top plate air gap, and second magnet assembly air gap are aligned and define a magnetic air gap. The magnetic air gap is configured to receive the voice coil.

In this example, the magnetic air gap of the loudspeaker magnet assembly has an air gap bottom that is covered by the bottom plate. The bottom plate may be circular having a perimeter and the bottom plate includes one or more radially arranged bottom plate slots extending inwardly from the outer perimeter of the bottom plate. These slots may have physical access to the magnetic air gap.

The annular outer magnet of the first magnet assembly may include at least one channel configured to pass a hookup wire from the voice coil outwards from the first magnet assembly. The annular outer magnet of the first magnet assembly may also be segmented into at least two segmented annular outer magnets, where the segmented annular outer magnets each include edges that define at least two channels of the at least one channel.

Figure 2:
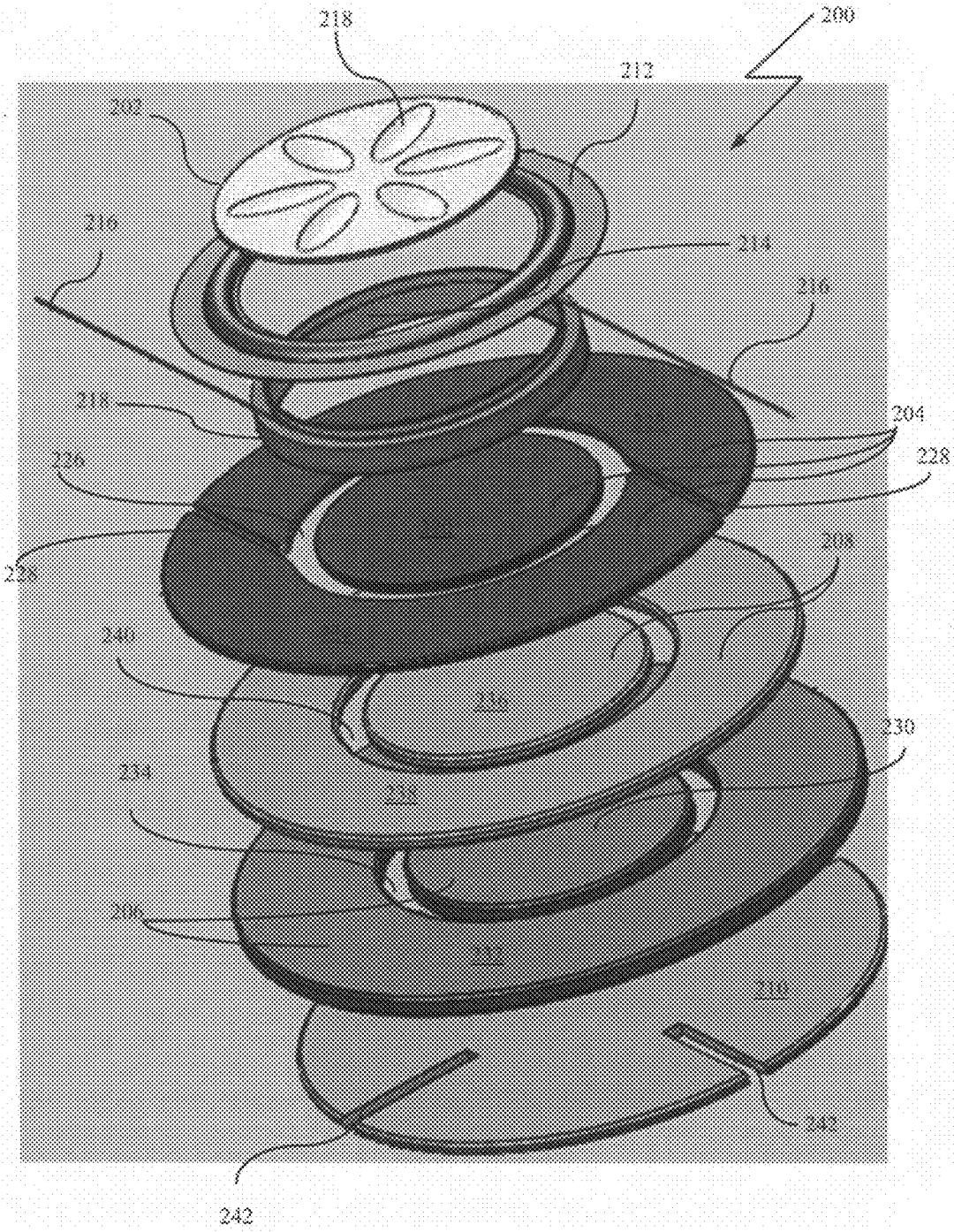
FIG. 2 is an exploded axonometric assembly view of an example of an implementation of a loudspeaker transducer in accordance with the present invention.

More specifically, turning to FIG. 2, an exploded axonometric assembly view of an example of an implementation of a loudspeaker transducer 200, in accordance with the present invention, is shown. The loudspeaker transducer 200 may be generally circular in construction and may include a diaphragm 202, a first magnet assembly 204, and a second magnet assembly 206 disposed between a top plate 208 and a bottom plate 210. As an example, the first magnet assembly 204, second magnet assembly 206, top plate 208, and bottom plate 210 may be attached (i.e., physically connected or coupled together), for example, with a two-part epoxy. The loudspeaker transducer 200 may also include a surround suspension member 212, for suspending the diaphragm 202, and a voice coil 214 having a pair of hookup wires 216 (also known as tensile lead wires) extending outwardly from the voice coil 214. The voice coil 214 is a wire winding of the hookup wires 216 around a former 218.

As shown, the diaphragm 202 may generally include a flat circular construction; however, one skilled in the art will recognize that the diaphragm 202 may include other constructions, such as a concave or convex shape. The flat shape of the diaphragm 202 is utilized to reduce the height of the loudspeaker transducer 200 so as to provide an overall lower profile package that is often desired for use in smaller applications, such as loudspeakers designed for use in portable, laptop, network, and tablet computers and mobile devices. The diaphragm 202 may be made from any suitable material that provides rigidity, such as titanium, aluminum or other metal, or non-metal material, such as plastic or impregnated/reinforced paper, or various impregnated textiles. To provide additional stiffness, a raised structure, for example flower design 218, may be embossed on top of the diaphragm 202.

Figure 1A:
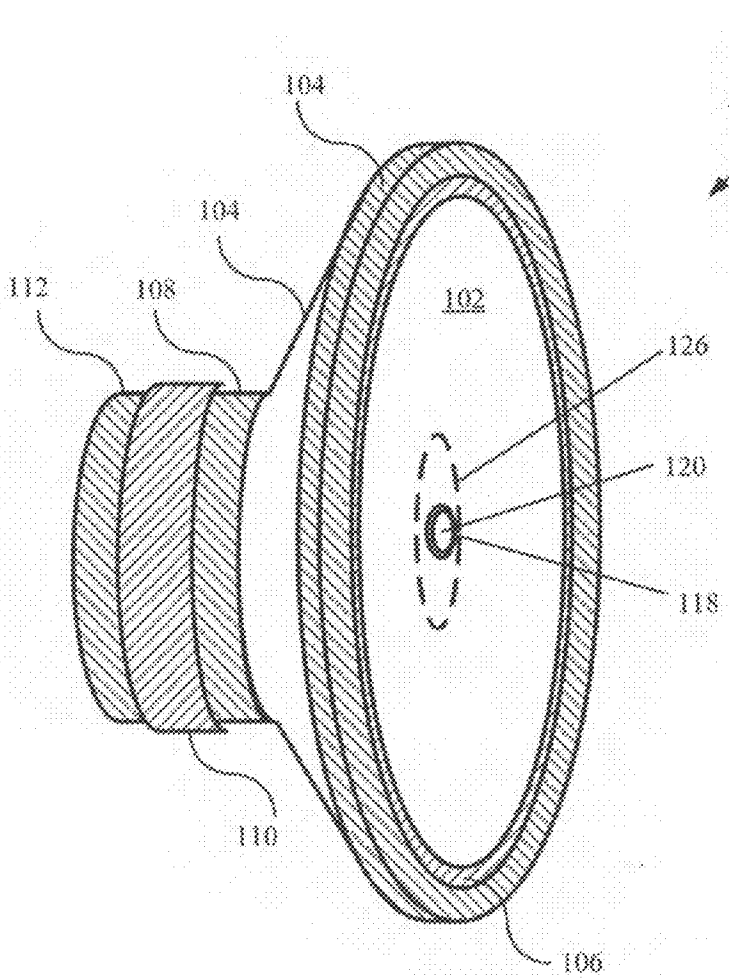
FIG. 1A (Prior Art)
FIG. 1A is perspective view of a known loudspeaker transducer.

The first magnet assembly 204 may be generally circular in construction and may include a circular inner magnet 220 and annular outer magnets 222 and 224. The circular inner magnet 220 and annular outer magnets 222 and 224 may be of any known magnet material commonly utilized in loudspeaker transducers. When assembled, the circular inner magnet 220 and annular outer magnets 222 and 224 may be concentrically spaced apart to define a first magnet assembly air gap 226 for passing the voice coil 214 and former 218, as will be discussed in further detail below. In addition, the annular outer magnets 222 and 224 may be segmented, as shown, to define one or more channels 228 for passing the hookup wires 216 from the voice coil 214 outwards from the loudspeaker transducer 200. While FIG. 1 shows two annular outer magnets 222 and 224 defining two channels 228, it is appreciated by those skilled in the art that only one annular outer magnet may also be used in this example with none or only one channel.

Moving from the first magnet assembly 204 to the second magnet assembly 206, the second magnet assembly 206 may be generally circular in construction and may include a circular inner permanent magnet 230 and an annular outer permanent magnet 232. The inner permanent magnet 230 and annular outer permanent magnet 232 may be of any known magnet material commonly utilized in loudspeaker transducers. When assembled, the inner permanent magnet 230 and annular outer permanent magnet 232 may be concentrically spaced apart to define a second magnet assembly air gap 234 for passing the voice coil 214 and former 218.

In another example, the annular outer permanent magnet 232 may be segmented into annular sections to define one or more channels (not shown) for providing acoustic venting. By providing venting, the sound pressure from the rear of the diaphragm 202 can communicate to the speaker "box" or enclosure (not shown), which is typically a bass-reflex or an acoustic suspension system. The channels (not shown) may include inlet and outlet ends which may be rounded, chamfered, or otherwise formed to shape the pressure wave propagating from the second magnet assembly air gap 234 to the speaker enclosure.

Turning to the top plate 208, the top plate 208 may be generally circular in construction and may include a circular inner top plate 236 and an annular outer top plate 238. The top plate 208 may be made of a magnetically soft iron, steel, or any other similar permeable material suited to function as a top plate and form a magnetic circuit with the first magnet assembly 204, inner permanent magnet 230, and bottom plate 210. When assembled, the circular inner top plate 236 and annular outer top plate 238 may be concentrically spaced apart to define a top plate air gap 240 for passing the voice coil 214 and former 218.

The bottom plate 210 may be generally circular in construction and may include one or more radially arranged bottom plate slots 242 extending inwardly from the outer perimeter of the bottom plate 210. The bottom plate 210 may be made of a magnetically soft iron, steel, or any other similar permeable material suited to function as a bottom plate and form a magnetic circuit with the first magnet assembly 204, inner permanent magnet 230, and top plate 208.

Figure 3:
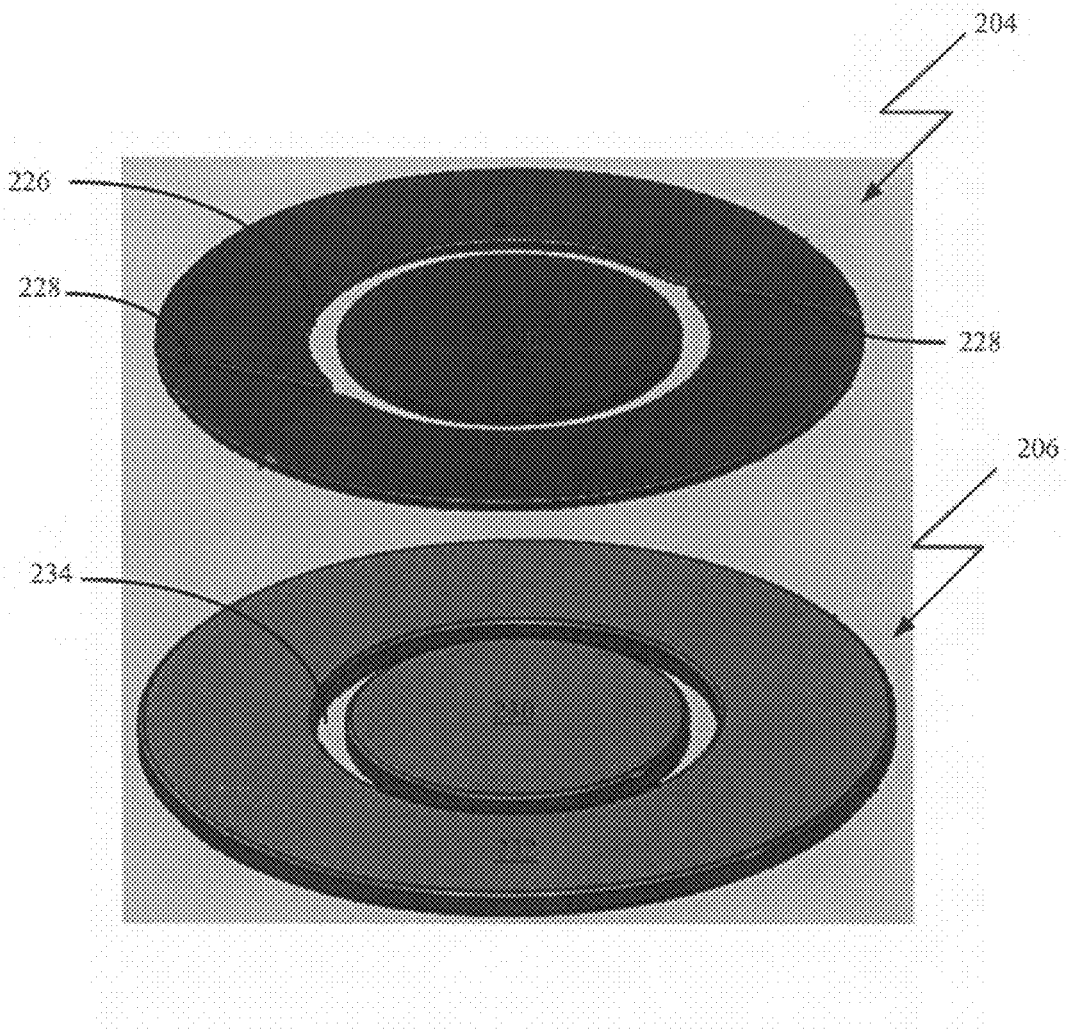
FIG. 3 is an exploded axonometric perspective view illustrating the first and second magnet assemblies of the loudspeaker transducer shown in FIG. 2.

In FIG. 3, an exploded axonometric perspective view illustrating the first magnet assembly 204 and second magnet assembly 206 of the loudspeaker transducer 200 (illustrated in FIG. 2) is shown. The first magnet assembly 204 is a transducer magnet for a low profile loudspeaker transducer. The first magnet assembly 204 may include an annular outer magnet having an outer perimeter, an outer diameter and an inner diameter. The inner diameter defines a vacant circular center within the annular outer magnet and the difference in length between the diameter of the circular inner magnet and the inner diameter of annular outer magnet define an annular first magnet assembly air gap. The annular outer magnet includes one or more channels extending inwardly from the outer perimeter of the annular outer magnet to the first magnet assembly air gap, and the first magnet assembly air gap is configured to receive the voice coil and the channels are configured to pass hookup wires from the voice coil to an external device from the transducer magnet.

More specifically, in FIG. 3, it is again appreciated by those skilled in the art that the annular outer magnets 222 and 224 may be combined to form one annular outer magnet (not shown) instead of the two annular outer magnets 222 and 224. As a result, the one annular outer magnet (not shown) would only have one channel instead of the two shown in FIG. 3. Similarly, the annular outer magnets 222 and 224 could be segmented into more than two sections (as is presently shown in FIG. 3) that would result in more than two channels 228 as is presently shown in FIG. 3. Additionally, as mentioned previously, in the second magnet assembly 206, the annular outer permanent magnet 232 may be segmented into annular sections to define one or more channels (not shown) for providing acoustic venting.

Figure 4A:
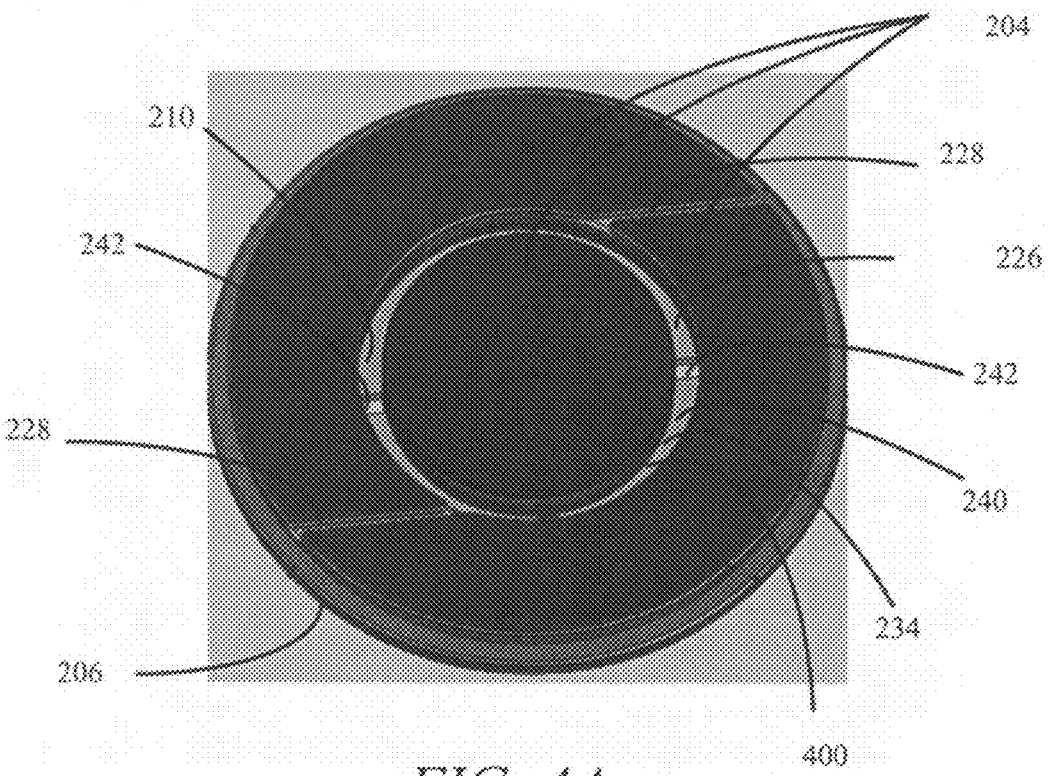
FIG. 4A is a top view of the magnet assemblies of the loudspeaker transducer shown in FIG. 2.
Figure 4B:
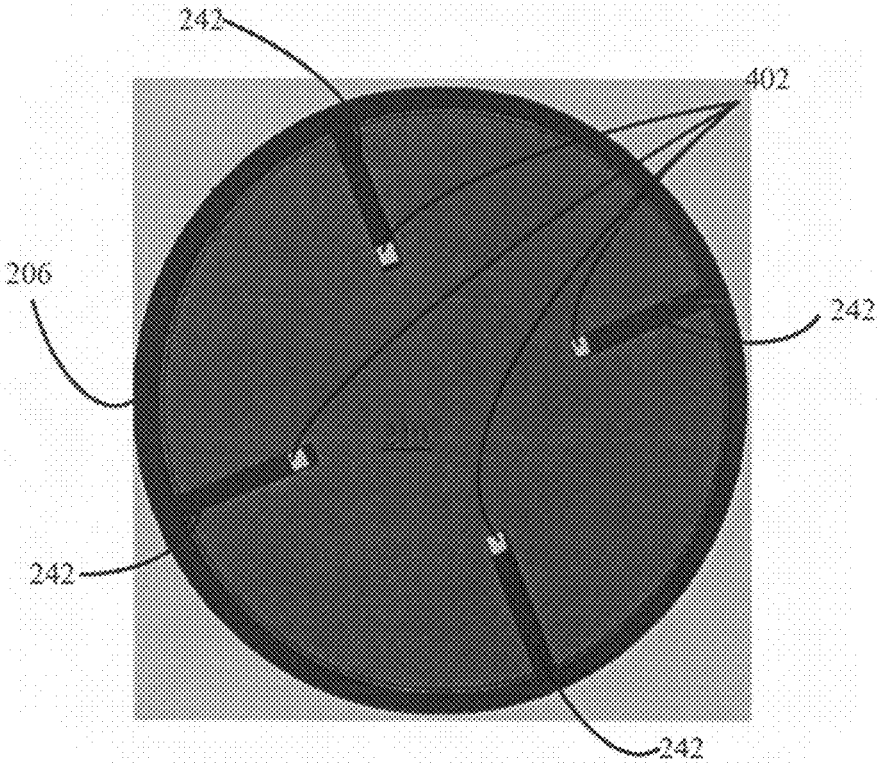
FIG. 4B is a bottom view of the bottom plate of the loudspeaker transducer shown in FIG. 2.

Turning to FIGS. 4A and 4B, in FIG. 4A, a top view of the magnet assemblies of the loudspeaker transducer 200 (illustrated in FIG. 2) is shown. This top view shows the first magnet assembly 204. As illustrated, the diameter of the first magnet assembly 204 is slightly less than the diameter of the second magnet assembly 206, and the channels 228 defined between the sections of the annular outer magnets 222 and 224 may be outwardly extended from the first magnet assembly air gap 226 (as defined in FIGS. 2 and 3), for example, tangent to the diametrical dimensions of the first magnet assembly air gap 226. It is appreciated by those skilled in the art that a total air gap 400 is defined by the combination of the first magnet assembly air gap 226, top plate air gap 240, and second magnet assembly air gap 234. Additionally, the total air gap 400 defines a cylindrical ring cavity that begins at the top face of the first magnet assembly 204 and ends at the top face of bottom plate 210. At the bottom of the total air gap 400 are open areas defined by the cylindrical ring cavity of the total air gap 400 and the radially arranged slots 242 of the bottom plate 210.

In FIG. 4B, a bottom view of the bottom plate 210 of the loudspeaker transducer 200 (illustrated in FIG. 2) is shown. As illustrated, the radially arranged slots 242 of the bottom plate 210 extend inwardly from the outer perimeter of the bottom plate 210 towards its center. In this example, an air passage, 402 is created between the individual slots 242 and the total air gap 400.

Figure 5:
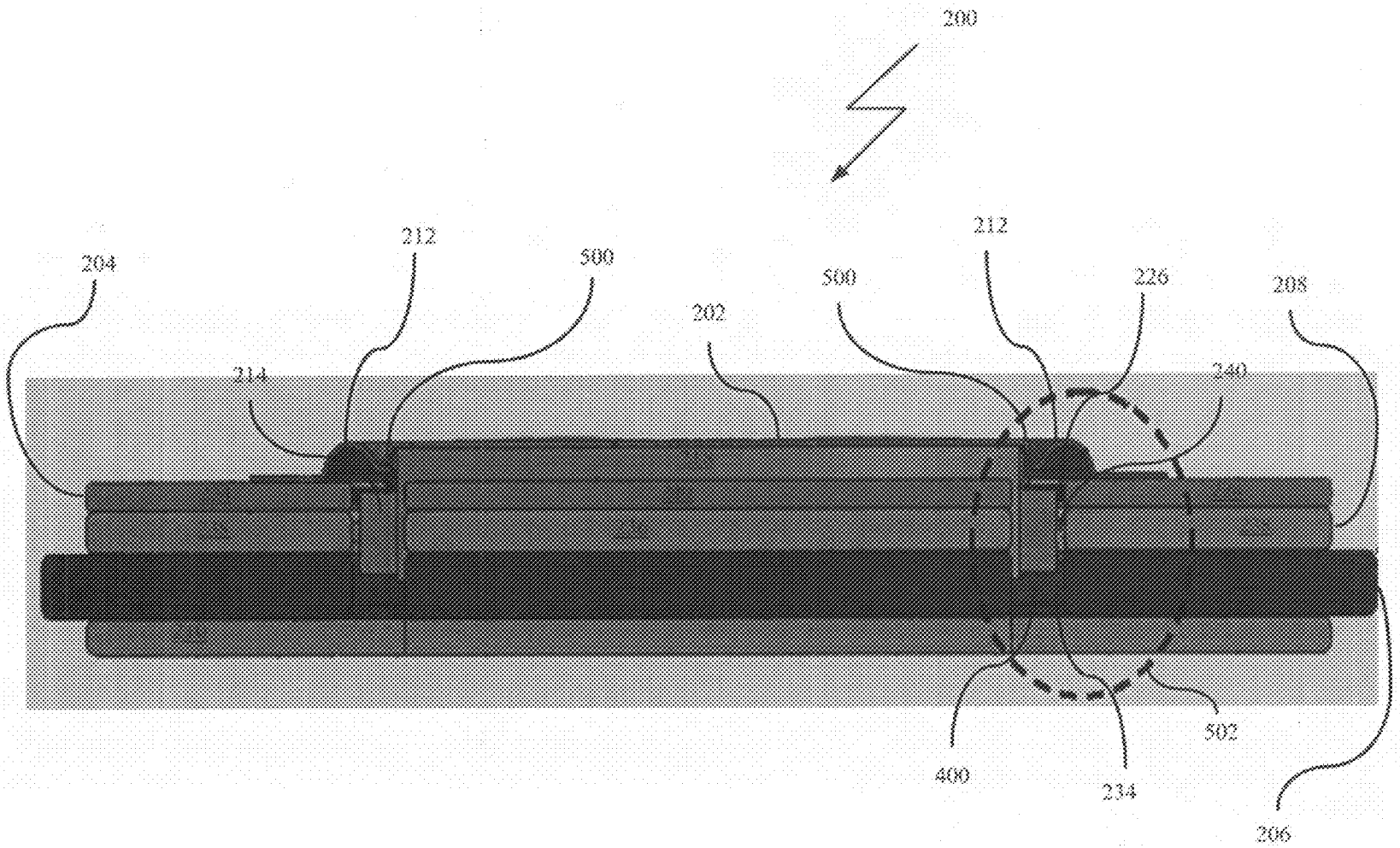
FIG. 5 is a cross-sectional view of the loudspeaker transducer shown in FIG. 2.

FIG. 5 is a cross-sectional view of the loudspeaker transducer 200 of FIG. 2. In FIG. 5, the bottom plate 210 is shown supporting a stack that includes the cylindrical permanent magnet (i.e., the second magnet assembly 206), the top plate 208, and the first magnet assembly 204. In this example, positioned above the second magnet assembly 206, in the stack, are the top plate 208 and the first magnet assembly 204 (that is positioned above the top plate 208).

As seen in FIG. 5, the diameter of the circular inner magnet 220 coincides with the diameters of the circular inner top plate 236 and inner permanent magnet 230 such that the first magnet assembly air gap 226, top plate air gap 240, and second magnet assembly air gap 234 are aligned and define the total air gap 400. Thus, the total air gap 400 is an annular space that is formed between circular inner magnet 220, annular outer magnet 224, circular inner top plate 236, annular outer top plate 238, circular inner permanent magnet 230, and annular outer permanent magnet 232, respectively. As such, the total air gap 400 is a "magnetic air gap." The voice coil 214 and former 218 is then positioned within the magnetic air gap 400 and extends upwardly to join to the diaphragm 202 at its outer perimeter 500. The former 218 and connecting diaphragm 202 are then supported in place by the surround suspension member 212 that is connected to the former 218, as further described below. The voice coil 214 may also include a wrapper (not shown) that encases the voice coil 214 and former 218. Thus, when reference is made to connecting or attaching the suspension member 212 or any other speaker component to the former 402, the attachment may be made either directly to the wrapper of the voice coil 214 and fowler 402 or directly to the voice coil 214 and former 218 when the former 218 is absent a wrapper. One skilled in the art will recognize that other configurations of the bottom plate 210, second magnet assembly 206, top plate 208, first magnet assembly 204, and voice coil 214 and former 218 may be utilized without departing from the scope of the invention.

Figure 6:
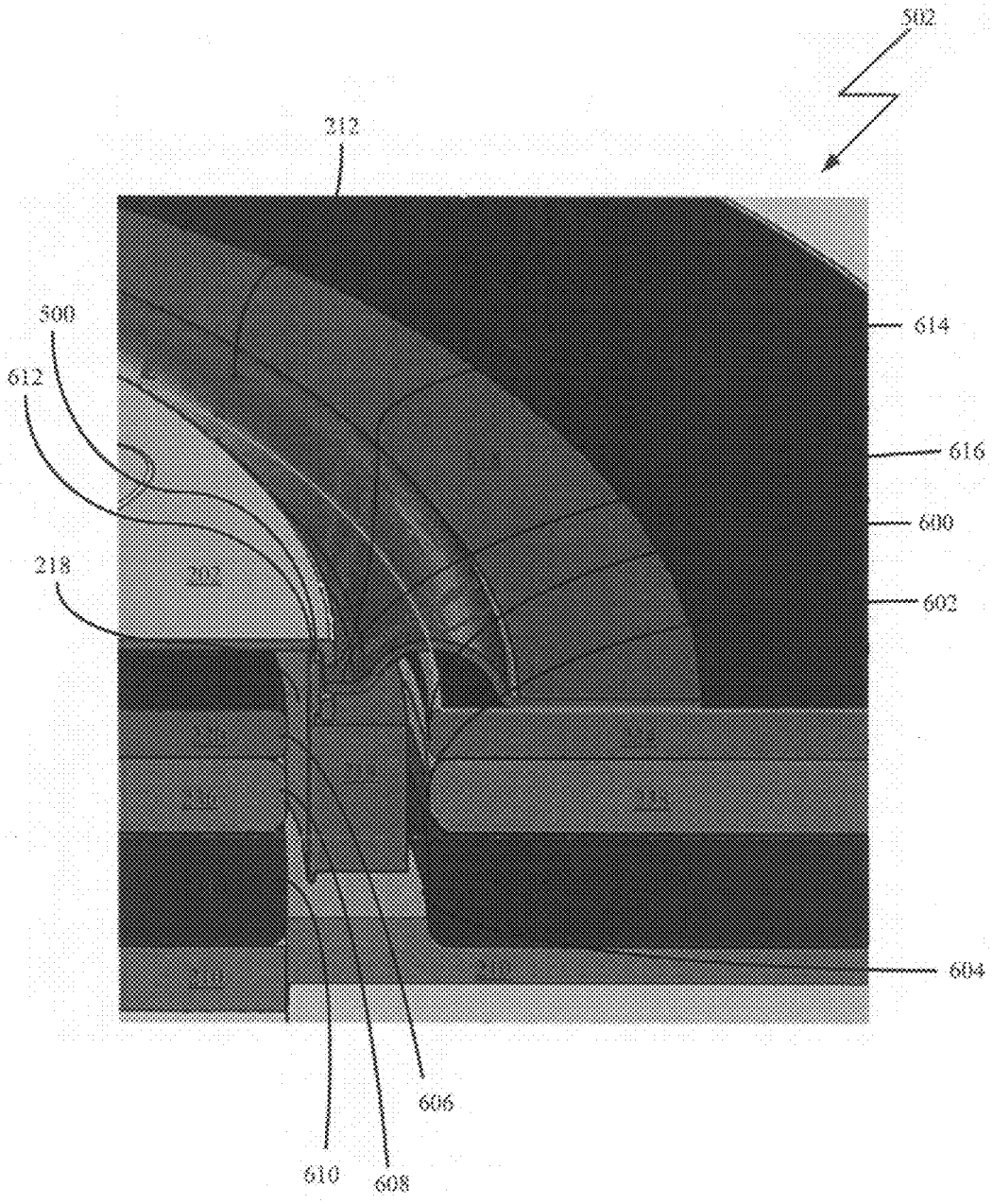
FIG. 6 is an enlarged perspective view of the encircled region shown in FIG. 5.

FIG. 6 is an enlarged view of the encircled region 502 of FIG. 5 and provides a more detailed illustration of the configuration of the surround suspension member 212 relative to the voice coil 214, former 218, and diaphragm 202. As described above, the voice coil 214 and former 218 is positioned in the magnetic air gap 400 between interior sides 600, 602, and 604 of annular outer magnet 224, annular outer top plate 238, annular outer permanent magnet 232, and exterior sides 606, 608, and 610 of circular inner magnet 220, circular inner top plate 236, and inner permanent magnet 230, respectively.

The voice coil 214 and former 218 then extends upward, in a direction parallel to the exterior sides 606, 608, and 610 of the circular inner magnet 220, circular inner top plate 236, and inner permanent magnet 230 and out of the magnetic air gap 400. In this example, the former 218 extends upward, to a point above the first magnet assembly 204, to connect with the diaphragm 202 of the loudspeaker transducer 200. The former 218 attaches to the diaphragm 202 at its upper end 612. The upper end 612 of the former 218 attaches to the underside of the outer perimeter edge 500 of the diaphragm 202 via an adhesive or other mechanism known in the art for mounting the diaphragm 202 to the former 218. In this example, the outer perimeter edge 500 is formed as a square end flange; however, alternative perimeter edge configurations may be used to attach the diaphragm 202 to the former 218. For example, the diaphragm 202 may be formed with an annular downward-facing channel that could flank the upper end 612 of the former 218 to facilitate locating and fastening operations.

As illustrated by FIG. 6, the surround suspension member 212 may be attached to the first magnet assembly 204, for example by an adhesive, to support the former 218 and diaphragm 202 and to maintain the alignment of the voice coil 214 and former 218 in the magnetic air gap 400. The surround suspension member 212 may include an inner edge 614, which may include a short flange 616, as shown. The inner edge 614 of the surround suspension member 212 may be attached to the former 218 at a location beneath the point at which the diaphragm 202 attaches to the upper end 612 of the former 218. An outer edge 618 of the surround suspension member 212 may be attached to the top surface 620 of annular outer magnet 224.

The surround suspension member 212 is configured and arranged to provide a degree of constraint to the maximum excursions of the voice coil 214, former 218 and, or, diaphragm 202 assembly in both the upward direction, which is not constrained otherwise, and in the lower direction, where the surround suspension member 212 acts to cushion the voice coil 114 and former 218 from the bottom plate 210. While the current configuration shows the surround suspension member 212 having an arc subtending an angle of 180 degrees or slightly less, the invention could be practiced utilizing known alternate configurations of surround suspension member 212, e.g., a series of concentric corrugations.

Figure 7:
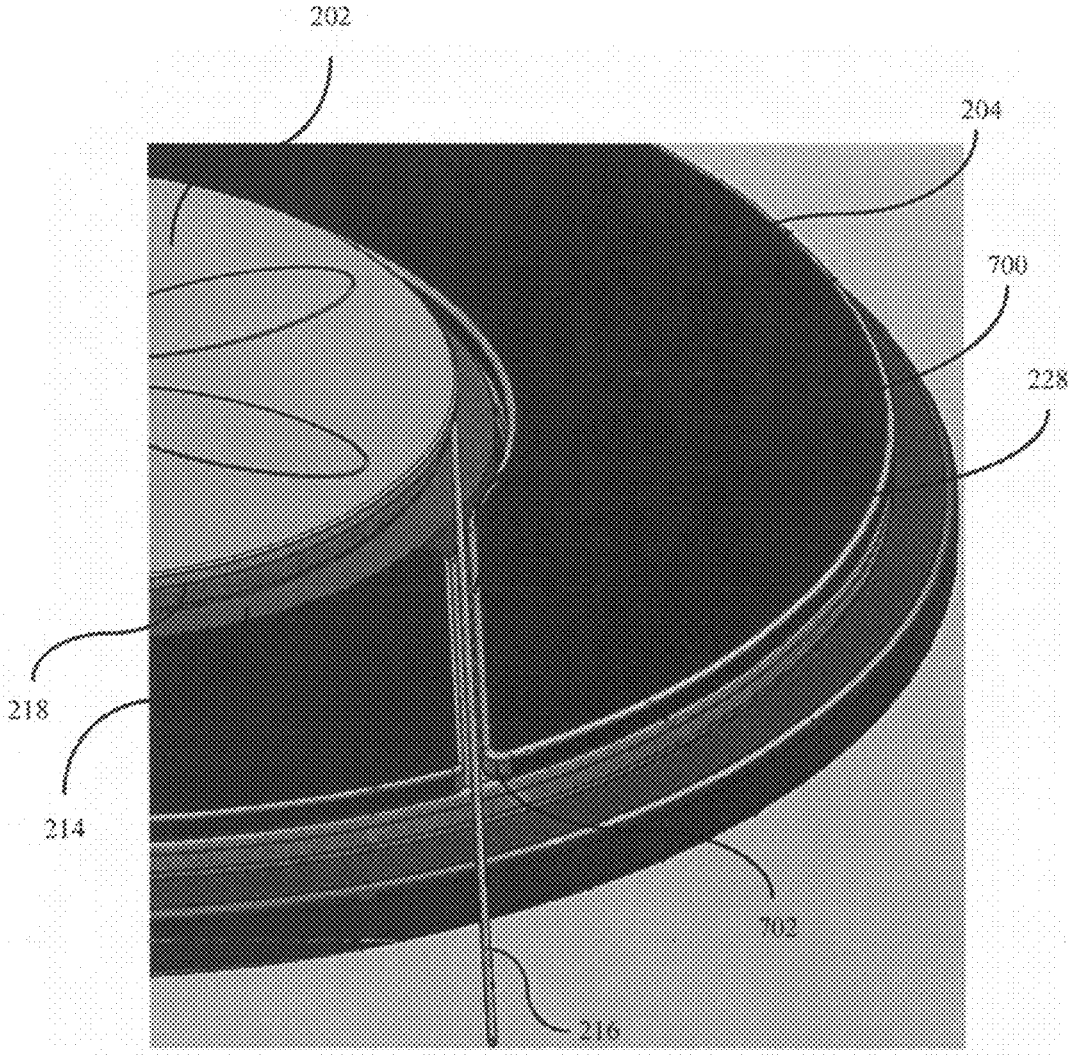
FIG. 7 is an enlarged perspective view of the channels formed in the first magnet assembly of the loudspeaker transducer shown in FIG. 2.

FIG. 7 is an enlarged perspective view of the channels formed in the first magnet assembly 204 of the loudspeaker transducer 200 of FIG. 1. For purposes of clarity, the surround suspension member 212 is not shown in this view. As shown, the channels 228 of the first magnet assembly 204 may include an inlet end 700 and an outlet end 702 for passing the hookup wires 216 from the voice coil 214 outside of the loudspeaker transducer 200. In operation, on one end, the hookup wires 216 may be connected through integrated flat conductors (not shown) to the former 218, as shown. At an opposite end, the hookup wires 216 may be connected to an electrical terminal (not shown) of the loudspeaker transducer 200.

Figure 8:
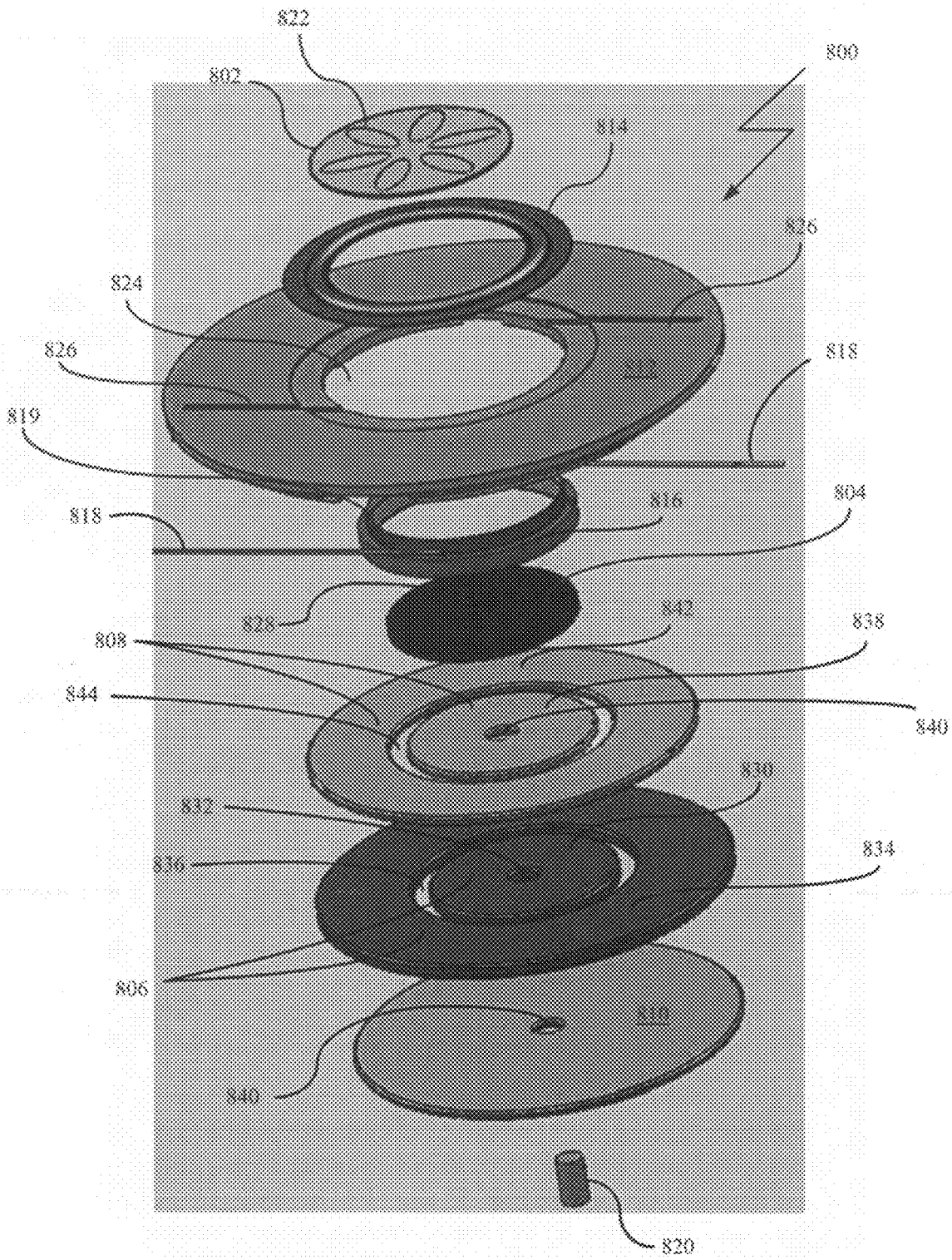
FIG. 8 is an exploded axonometric assembly view of another example of an implementation of a loudspeaker transducer in accordance with the present invention.

Turning to FIG. 8, another example of an implementation of loudspeaker magnet assembly for a loudspeaker transducer having a voice coil, surround suspension member, and diaphragm is shown in accordance with the invention. The loudspeaker magnet assembly may include: a baffle; first magnet assembly; top plate positioned below the first magnet assembly; second magnet assembly positioned below the top plate; bottom plate positioned below the second magnet assembly; and a plug.

The baffle may include a central bore and the first magnet assembly may also include a central bore. The top plate may include an annular outer top plate and a circular inner top plate. The annular outer top plate has an outer diameter and an inner diameter, where the inner diameter defines a vacant circular center within the annular outer top plate. The circular inner top plate has a diameter less than the inner diameter of the annular outer top plate and is positioned concentrically within the vacant circular center of the annular outer top plate. The difference in length between the diameter of the circular inner top plate and the inner diameter of annular outer top plate define an annular top plate air gap. The circular inner top plate may also include a central bore.

The second magnet assembly may include an annular outer magnet and a circular inner magnet. The annular outer magnet has an outer diameter and an inner diameter, where the inner diameter defines a vacant circular center within the annular outer magnet. The circular inner magnet has a diameter less than the inner diameter of the annular outer magnet and is positioned concentrically within the vacant circular center of the annular outer magnet. The difference in length between the diameter of the circular inner magnet and the inner diameter of annular outer magnet define an annular second magnet assembly air gap. The circular inner magnet may also include a central bore.

Additionally, the bottom plate may include a central bore and the plug is configured to fit within the central bores of the bottom plate, circular inner magnet of the second magnet assembly, circular inner top plate, and the first magnet assembly.

The diameter of the first magnet assembly, coincides with the diameters of the circular inner top plate and circular inner magnet of the second magnet assembly, such that the top plate air gap and second magnet assembly air gap are aligned and define a magnetic air gap. The magnetic air gap is configured to receive the voice coil. The baffle may be circular having a perimeter where the baffle includes one or more passages extending inwardly from the outer perimeter of the baffle to the central bore of the baffle so as to pass the hookup wires from the voice coil to devices external to loudspeaker transducer.

FIG. 8 illustrates an exploded axonometric assembly view of another example of an implementation of a loudspeaker transducer 800 of the present invention. The loudspeaker transducer 800 may be generally circular in construction and may include a diaphragm 802, a first magnet assembly 804, and a second magnet assembly 806 disposed between a top plate 808 and a bottom plate 810. In some implementations, the first magnet assembly 804, second magnet assembly 806, top plate 808, and bottom plate 810 maybe attached (such as, for example, physically connected or coupled) together, for example, by a two-part epoxy. Also illustrated is a baffle 812 and a surround suspension member 814 for suspending the diaphragm 802 and a voice coil 816 having a pair of hookup wires 818, or tinsel lead wires, extending outwardly from the voice coil 816. The voice coil 816 may be wrapped around a former 819. The first magnet assembly 804, second magnet assembly 806, a top plate 808, and bottom plate 810 may be assembled together by a plug 820 configured to pass through the center of these loudspeaker transducer 800 members.

As shown, the diaphragm 802 may generally include a flat circular construction; however, one skilled in the art will recognize that the diaphragm 802 may include other constructions, such as a concave or convex shape. The flat shape of diaphragm 802 is used to reduce the height of the loudspeaker transducer 800 to provide an overall lower profile package that is often desired for use in smaller applications, such as loudspeakers designed for use in portable, laptop, network, and tablet computers and mobile devices. The diaphragm 802 may be made from any suitable material that provides rigidity, such as titanium, aluminum or other metal, or non-metal material, such as plastic or impregnated/reinforced paper, or various impregnated textiles. To provide additional stiffness, a raised structure, for example flower design 822, may be embossed on top of the diaphragm 802.

The baffle 812 may generally include an annular construction and a central bore 824 for passing at least a portion of the voice coil 816 and former 819 therethrough, as will be discussed in more detail below. The baffle 812 may also include a pair of opposing passages 826 for passing the hookup wires 818 from the voice coil 816 outwards to the exterior of the loudspeaker transducer 800. The opposing passages 826 are similar to the channels 228 shown in FIGS. 2 and 3, 4A, and 7, except that the channels 228 are in a magnetic material such as first magnet assembly 204, while the passages 826 are in a non-magnetic baffle 812.

As shown, the first magnet assembly 804 may be a generally disc shaped magnet having a first magnet central bore 828 for receiving the plug 820. The first magnet assembly 804 may be of any known magnet material commonly utilized in loudspeaker transducers.

Moving from the first magnet assembly 804 to the second magnet assembly 806, the second magnet assembly 806 may be generally circular in construction and may include a circular inner permanent magnet 830 having a second magnet central bore 832, and an annular outer permanent magnet 834. The circular inner permanent magnet 830 and annular outer permanent magnet 834 may be of any known magnet material commonly utilized in loudspeaker transducers. When assembled, the circular inner permanent magnet 830 and annular outer permanent magnet 834 may be concentrically spaced apart to define a second magnet air gap 836 for passing the voice coil 816 and former 819.

Turning to the top plate 808, the top plate 808 may be generally circular in construction and may include a circular inner top plate 838 having a central bore 840, and an annular outer top plate 842. The top plate 808 may be made of a magnetically soft iron, steel, or any other material suited to function as a top plate and form a magnetic circuit with the first magnet assembly 804, second magnet assembly 806, and bottom plate 810. When assembled, the circular inner top plate 838 and annular outer top plate 842 may be concentrically spaced apart to define a top plate air gap 844 for passing the voice coil 816 and former 819.

The bottom plate 810 may include a circular disc shape and a bottom plate central bore 846. The bottom plate 810 may be made of a magnetically soft iron, steel, or any other similar permeable material suited to function as a bottom plate and form a magnetic circuit with the first magnet assembly 804, second magnet assembly 806, and top plate 808.

Figure 9:
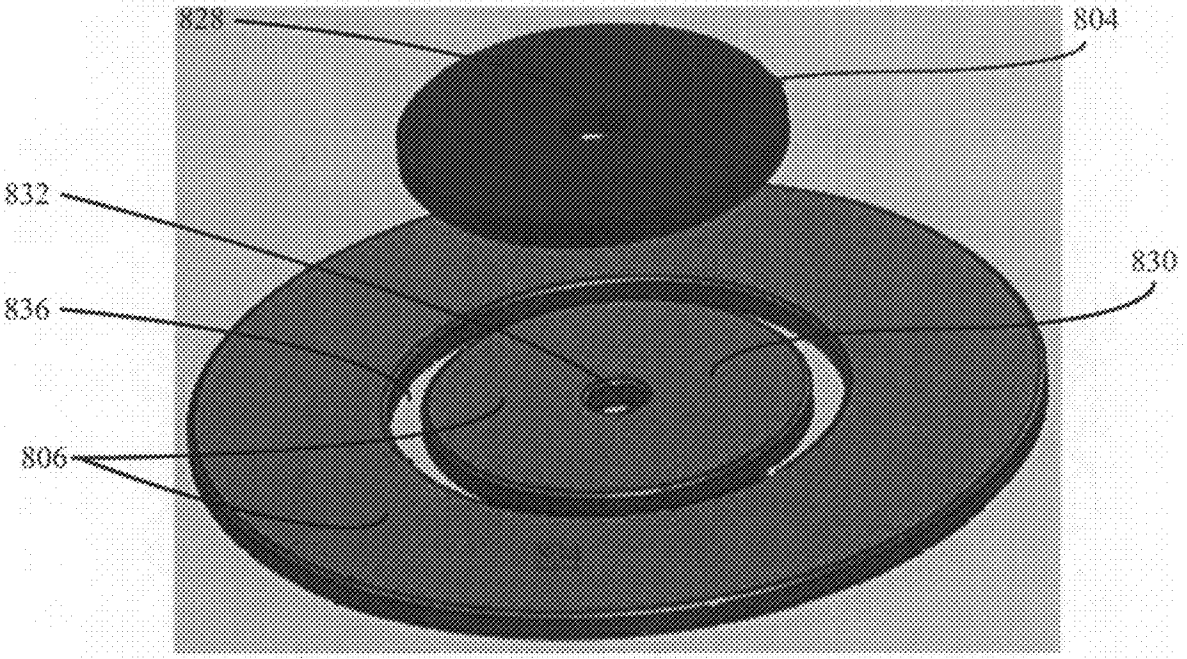
FIG. 9 is an exploded axonometric perspective view illustrating the first and second magnet assemblies of the loudspeaker transducer shown in FIG. 8.

In FIG. 9, an exploded axonometric perspective view illustrating the first magnet assembly 804 and second magnet assembly 806 of the loudspeaker transducer 800 (illustrated in FIG. 8) is shown. As described above, the first magnet assembly 804 may be a generally disc shaped magnet having the first magnet central bore 828 for receiving the plug 820. The second magnet assembly 806 may be generally circular in construction and may include the circular inner permanent magnet 830 having the second magnet central bore 832, and annular outer permanent magnet 834.

Figure 10A:
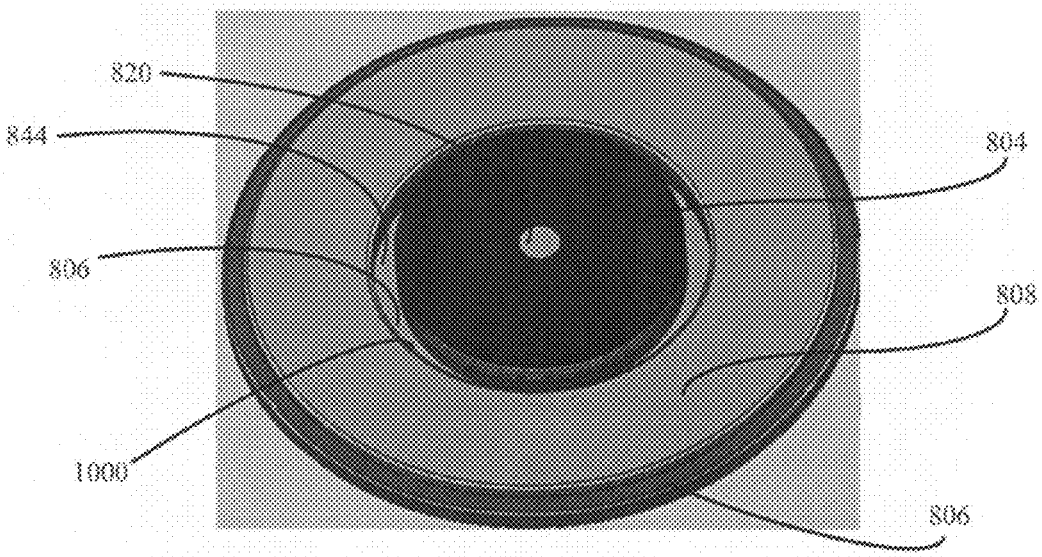
FIG. 10A is a top view of the magnet assemblies of the loudspeaker transducer shown in FIG. 8.

FIG. 10A is a top view of the magnet assemblies of the loudspeaker transducer 800 of FIG. 8. This top view depicts the first magnet assembly 804, top plate 808, second magnet assembly 806, and bottom plate (not shown in this view) assembled via the plug 820. In some implementations, the first magnet assembly 804, top plate 808, second magnet assembly 806, and bottom plate (not shown) may be coupled together at the plug by an adhesive, weldment, press fit, or other securing means. As illustrated, the diameter of the top plate 808 is slightly less than the diameter of the second magnet assembly 806. It is appreciated by those skilled in the art that a total air gap 1000 is defined by the combination of the top plate air gap 844 and second magnet assembly air gap 836. Additionally, the total air gap 1000 defines a cylindrical ring cavity that begins at the top face of the top plate 808 and ends at the top face of bottom plate 810.

Figure 10B:
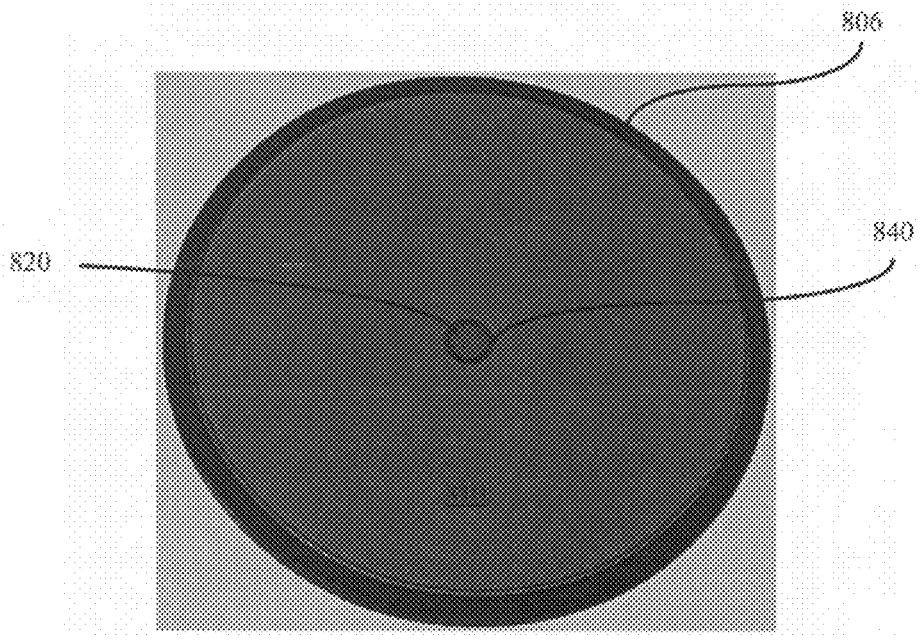
FIG. 10B is a bottom view of the magnet assemblies of the loudspeaker transducer shown in FIG. 8.

FIG. 10B is a bottom view of the magnet assemblies of the loudspeaker transducer 800 of FIG. 8. This bottom view depicts the first magnet assembly 804 (not shown in this view), top plate 808 (not shown in this view), second magnet assembly 706, and bottom plate 810 assembled via the plug 720. As illustrated, when assembled, the plug 820 engages the bottom of the loudspeaker transducer 800 via the bottom plate central bore 840 in the bottom plate 810.

Figure 11:
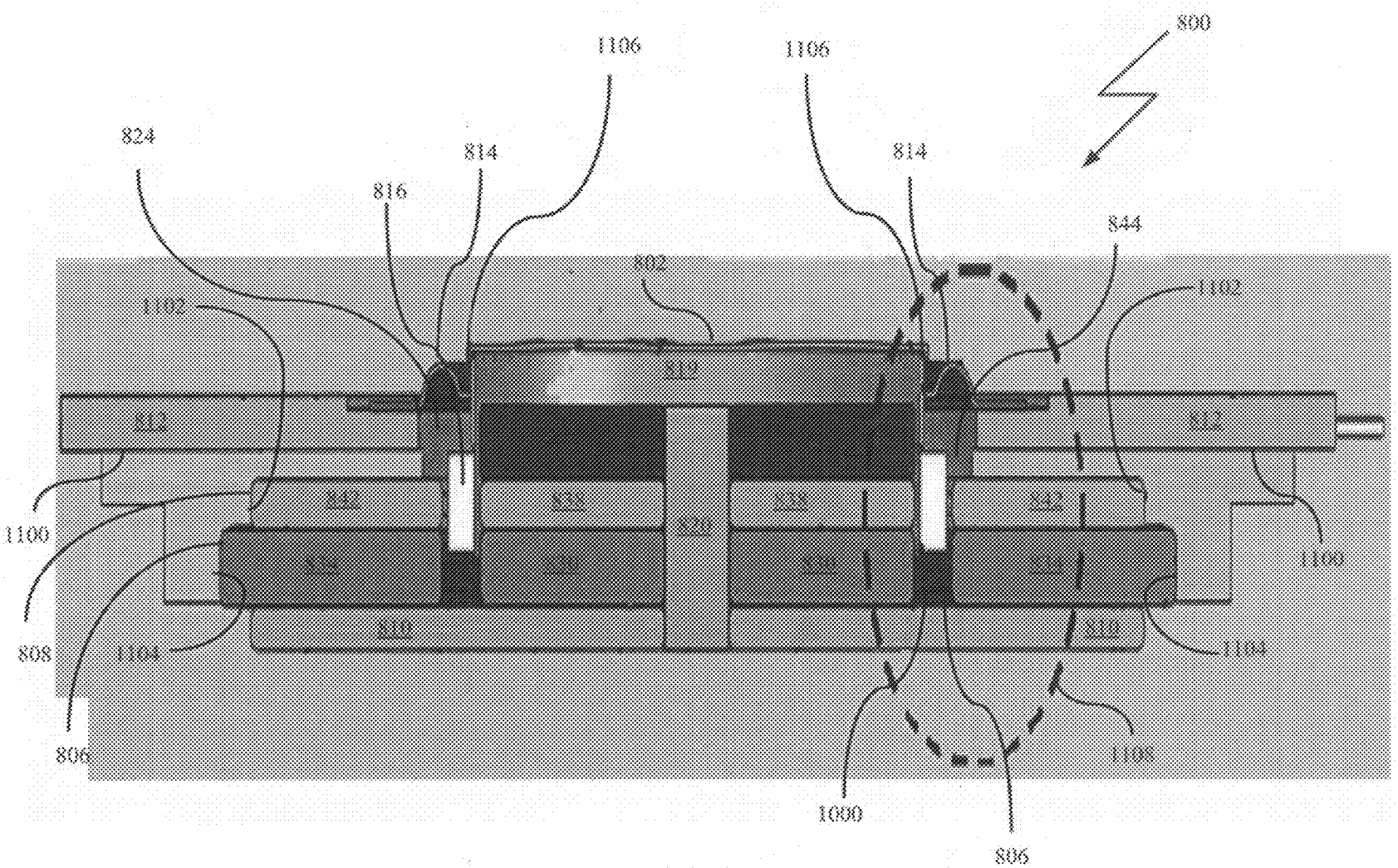
FIG. 11 is a cross-sectional view of the loudspeaker transducer shown in FIG. 8.

FIG. 11 is a cross-sectional view of the loudspeaker transducer 800 of FIG. 8. In FIG. 11, the bottom plate 810 is shown supporting a stack that includes the cylindrical permanent magnet (i.e., the second magnet assembly 806), top plate 808, and first magnet assembly 804. In this example, positioned above the second magnet assembly 806 is the top plate 808, in the stack, are the top plate 808, first magnet assembly 804 (that is positioned above the circular inner top plate 838 of the top plate 808), and the baffle 812. The baffle 812 has an underside 1100 that may include a pair of concentric radial surfaces 1102 and 1104 that are configured to complement the diametrical dimensions of the annular outer top plate 842 and annular outer permanent magnet 834, respectively.

As seen in FIG. 11, the diameter of the first magnet assembly 704 coincides with the diameters of the circular inner top plate 838 and circular inner permanent magnet 830 such that the top plate air gap 844 and second magnet assembly air gap 806 are aligned and define the total air gap 1000. Thus, the total air gap 1000 is an annular space that is formed between the circular inner top plate 838, annular outer top plate 842, circular inner permanent magnet 830, and annular outer permanent magnet 834, respectively. As such, the total air gap 1000 is a "magnetic air gap."

The voice coil 816 and former 819 is then positioned within the magnetic air gap 1000 and extends upwardly to join to the diaphragm 802 at its outer perimeter 1106. The former 819 and connecting diaphragm 802 are then supported in place by the surround suspension member 814 that is connected to the former 819, as further described below. The voice coil 816 may also include a wrapper (not shown) that encases the voice coil 816 and former 819. Thus, when reference is made to connecting or attaching the suspension member 814 or any other speaker component to the former 819, the attachment may be made either directly to the wrapper of the voice coil 816 and former 819 or directly to the voice coil 816 and former 819 when the former 819 is absent a wrapper.

As also shown, when assembled, the plug 820 engages the stack and extends through the bottom plate central bore 840, second magnet central bore 832, top plate central bore 840, first magnet central bore 828, and central bore 824 of the baffle 812 (where the first magnet assembly 804 is also located within the central bore 824 of the baffle 812). One skilled in the art will recognize that other configurations of the bottom plate 810, second magnet assembly 806, top plate 808, first magnet assembly 804, and voice coil 816 and former 819 may be utilized without departing from the scope of the invention.

Figure 12:
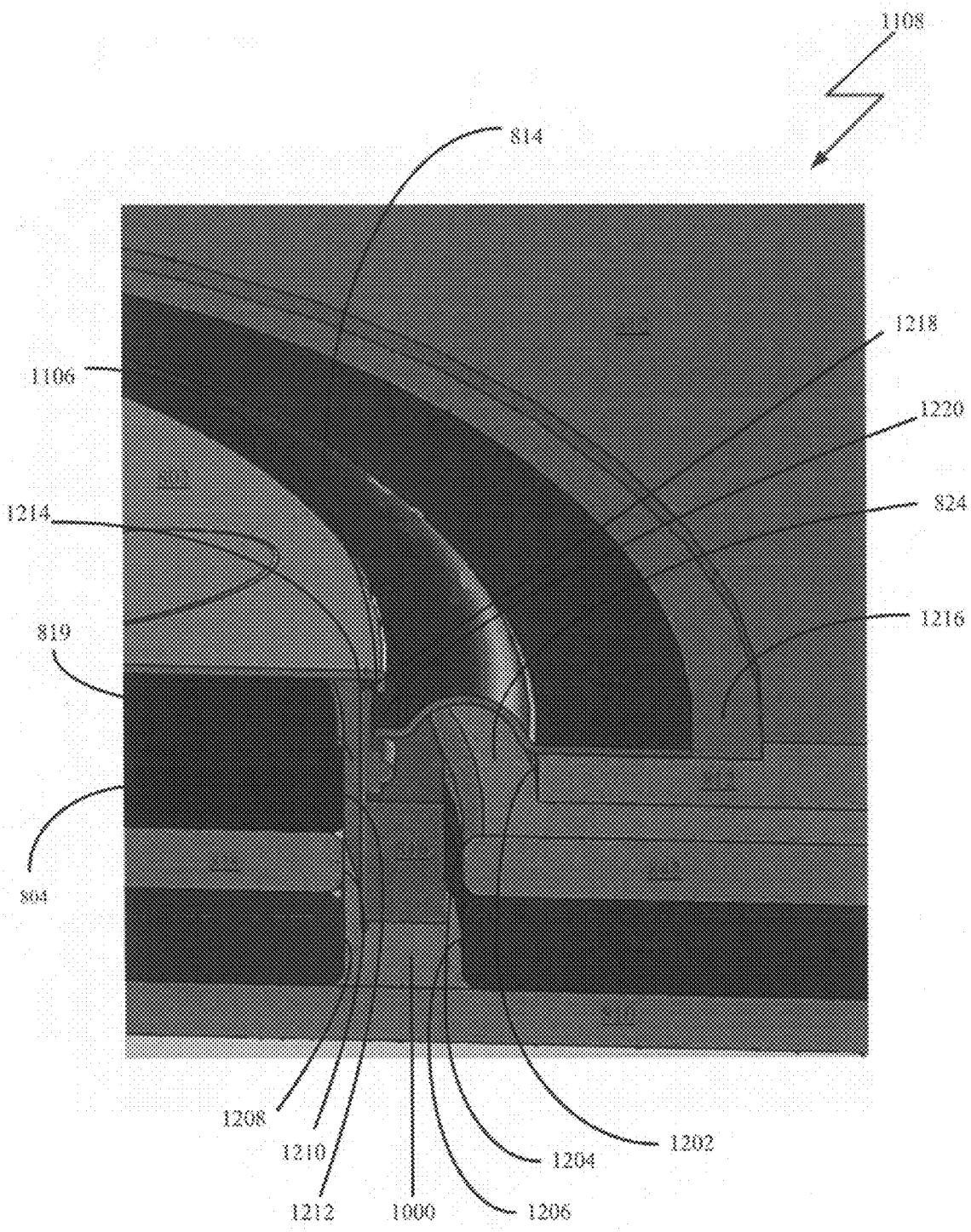
FIG. 12 is an enlarged perspective view of the encircled region shown in FIG. 11.

FIG. 12 is an enlarged view of the encircled region 1108 of FIG. 11 and provides a more detailed illustration of the configuration of the suspension member 814 relative to the voice coil 816, former 819, and diaphragm 802. As described above, the voice coil 816 and former 819 are positioned in the magnetic air gap 1006 between exterior sides 1202, 1204, and 1206 of central bore 824 of the baffle 812, annular outer top plate 842, and annular outer permanent magnet 834, and interior sides 1208, 1210, and 1212 of the first magnet assembly 804, circular inner top plate 838, and circular inner permanent magnet 830, respectively.

The voice coil 816 and former 819 then extends upward, in a direction parallel to the interior sides 1208, 1210, and 1212 of the first magnet assembly 804, circular inner top plate 838, and circular inner permanent magnet 830 and out of the magnetic air gap 1000. In this example, the former 819 extends upward, to a point above the first magnet assembly 804, to connect with the diaphragm 802 of the loudspeaker transducer 800. The former 819 attaches to the diaphragm 802 at its upper end 1214. The upper end 1214 of the former 819 attaches to the underside of the outer perimeter edge 1106 of the diaphragm 802 via an adhesive or other mechanism known in the art for mounting the diaphragm 802 to the former 819. In this example, the outer perimeter edge 1106 is formed as a square end flange; however, alternative perimeter edge configurations may be used to attach the diaphragm 802 to the former 819. For example, the diaphragm 802 may be formed with an annular downward-facing channel that could flank the upper end 1214 of former 819 to facilitate locating and fastening operations.

As illustrated by FIG. 12, the surround suspension member 814 may be attached to a landing region 1216 surrounding the central bore 824 of the baffle 812 to support the former 819 and diaphragm 802 and to maintain the alignment of the voice coil 816 and former 819 in the magnetic air gap 1000. The surround suspension member 814 may include an inner edge 1218, which may include a short flange 1220, as shown. The inner edge 1218 of the surround suspension member 814 may be attached, for example by an adhesive, to the former 819 at a location beneath the point at which the diaphragm 802 attaches to the upper end 1214 of the former 1819. An outer edge 1222 of the surround suspension member 814 may be attached to the landing region 1216.

Figure 13:
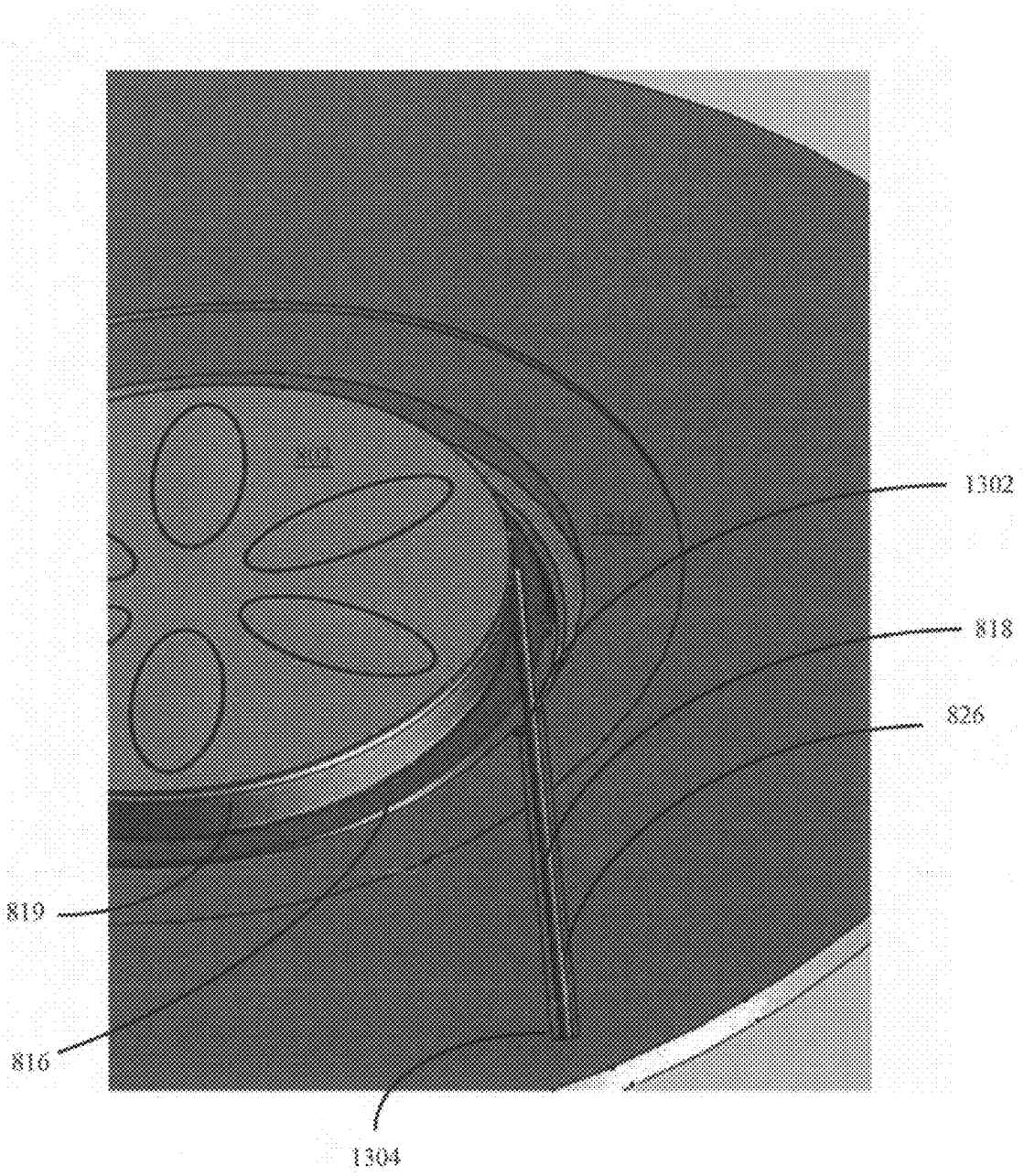
FIG. 13 is an enlarged perspective view of the passages formed in the baffle of the loudspeaker transducer shown in FIG. 8.

FIG. 13 is an enlarged perspective view of the passages formed in the baffle of the loudspeaker transducer 800 of FIG. 8. For purposes of clarity, the surround suspension member 814 is not depicted in this view. As shown, the passages 826 of the baffle 812 may include an inlet end 1302 and an outlet end 1304 for passing the tinsel lead wires (i.e., hookup wires 818) from the voice coil 816 outside of the loudspeaker transducer 800. In operation, the tinsel lead wires 818 may be connected through integrated flat conductors (not shown) to the former 819 of the voice coil 816, as shown.

As another example of an implementation of loudspeaker magnet assembly for a loudspeaker transducer having a voice coil, surround suspension member, and diaphragm is shown in accordance with the invention. The loudspeaker magnet assembly may include: a first magnet assembly; top plate positioned below the first magnet assembly; second magnet assembly positioned below the top plate; bottom plate positioned below the second magnet assembly; and a plug.

The first magnet assembly may include an annular outer magnet and a circular inner magnet. The annular outer magnet has an outer diameter and an inner diameter, where the inner diameter defines a vacant circular center within the annular outer magnet. The circular inner magnet has a diameter less than the inner diameter of the annular outer magnet and is positioned concentrically within the vacant circular center of the annular outer magnet. The difference in length between the diameter of the circular inner magnet and the inner diameter of annular outer magnet define an annular first magnet assembly air gap. The circular inner magnet may also include a central bore.

The top plate may include an annular outer top plate and a circular inner top plate. The annular outer top plate has an outer diameter and an inner diameter, where the inner diameter defines a vacant circular center within the annular outer top plate. The circular inner top plate has a diameter less than the inner diameter of the annular outer top plate and is positioned concentrically within the vacant circular center of the annular outer top plate. The difference in length between the diameter of the circular inner top plate and the inner diameter of annular outer top plate define an annular top plate air gap. The circular inner top plate may also include a central bore.

The second magnet assembly may include an annular outer magnet and a circular inner magnet. The annular outer magnet has an outer diameter and an inner diameter, where the inner diameter defines a vacant circular center within the annular outer magnet. The circular inner magnet has a diameter less than the inner diameter of the annular outer magnet and is positioned concentrically within the vacant circular center of the annular outer magnet. The difference in length between the diameter of the circular inner magnet and the inner diameter of annular outer magnet define an annular second magnet assembly air gap. The circular inner magnet may also include a central bore.

Additionally, the bottom plate may include a central bore and the plug is configured to fit within the central bores of the bottom plate, circular inner magnet of the second magnet assembly, circular inner top plate, and circular inner magnet of the first magnet assembly.

The diameter of the circular inner magnet, of the first magnet assembly, coincides with the diameters of the circular inner top plate and circular inner magnet of the second magnet assembly, such that the first magnet assembly air gap, top plate air gap, and second magnet assembly air gap are aligned and define a magnetic air gap. The magnetic air gap is configured to receive the voice coil.

In this example, the magnetic air gap of the loudspeaker magnet assembly has an air gap bottom that is covered by the bottom plate. The bottom plate may be circular having a perimeter and the bottom plate includes one or more radially arranged bottom plate slots extending inwardly from the outer perimeter of the bottom plate. These slots may have physical access to the magnetic air gap.

The annular outer magnet of the first magnet assembly may include at least one channel configured to pass a hookup wire from the voice coil outwards from the first magnet assembly. The annular outer magnet of the first magnet assembly may also be segmented into at least two segmented annular outer magnets, where the segmented annular outer magnets each include edges that define at least two channels of the at least one channel.

The annular outer top plate may also be segmented where the annular outer top plate has an outer perimeter and the annular outer top plate is segmented into at least two segmented annular outer top plates. In this example, the segmented annular outer top plates each include edges that define one or more air channels within the top plate, where the air channels extend radially inward from the outer perimeter to the top plate air gap.

Figure 14:
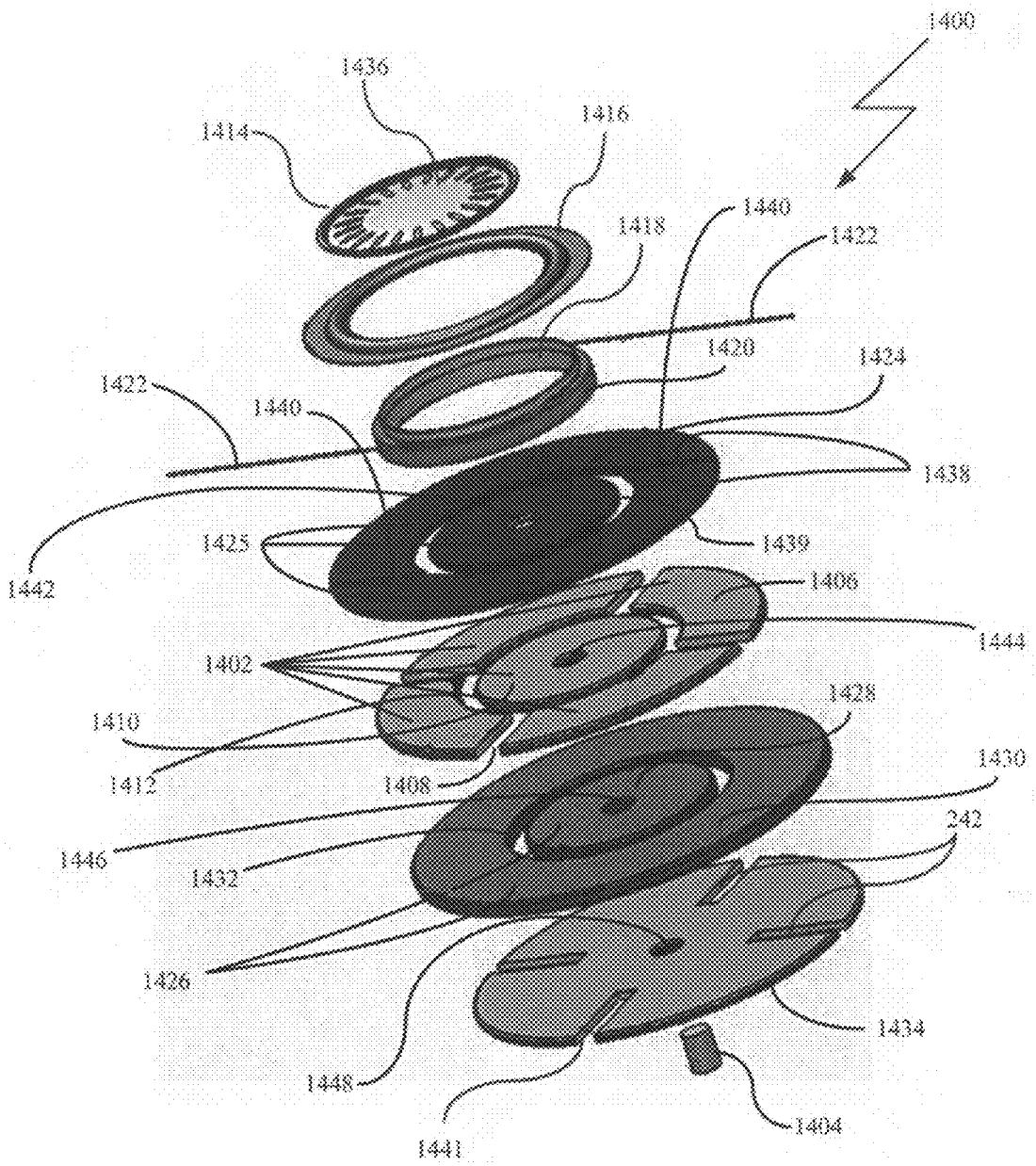
FIG. 14 is an exploded axonometric assembly view of yet another example of an implementation of a loudspeaker transducer of the present invention.

More specifically in FIG. 14, an exploded axonometric assembly view of yet another example of an implementation of a loudspeaker transducer 1400, of the present invention, is shown. This example of an implementation is similar to the implementation of the invention shown in FIGS. 2 and 8 with the difference that the loudspeaker transducer 1400 in this example includes a segmented top plate 1402 and a plug 1404. This example also features a top plate 1402 that is segmented into annular outer top plate sections 1406 to define one or more top plate air channels 1408 to allow acoustic venting. The top plate 1402 may also include a circular inner top plate 1410 and top plate air gap 1412. By providing venting, the sound pressure from the rear of the diaphragm 1414 can communicate to the speaker enclosure (not shown).

Similar to the examples shown in FIGS. 2 and 11, in this example, the loudspeaker transducer 1400 may also include: a surround suspension member 1416; former 1418; voice coil 1420; hookup wires 1422; circular inner magnet 1424 of a first magnet assembly 1425; second magnet assembly 1426 having a circular inner permanent magnet 1428, annular outer permanent magnet 1430, and second magnet air gap 1432; bottom plate 1434; and raised structure 1436.

Furthermore, unlike FIG. 11 but similar FIG. 2, in this example, the first magnet assembly 1425 may also include two annular outer magnets 1438 and a first magnet assembly air gap 1439 and at least one channel 1440 within the annular outer magnets 1438 for passing the hookup wires 1422 from the voice coil 1420 outwards from the loudspeaker transducer 1400. The bottom plate 1434 may also include a plurality radially arranged bottom plate slots 1441 extending inwardly from the outer perimeter of the bottom plate 1434. Moreover, unlike FIG. 2 but similar to FIG. 11, in this example, the loudspeaker transducer 1400 may include a first magnet central bore 1442 within the first magnet assembly 1425, a top plate central bore 1444 within the top plate 1402, a second magnet central bore 1446 within the second magnet assembly 1426, a bottom plate central bore 1448 within the bottom plate 1434.

Figure 15:
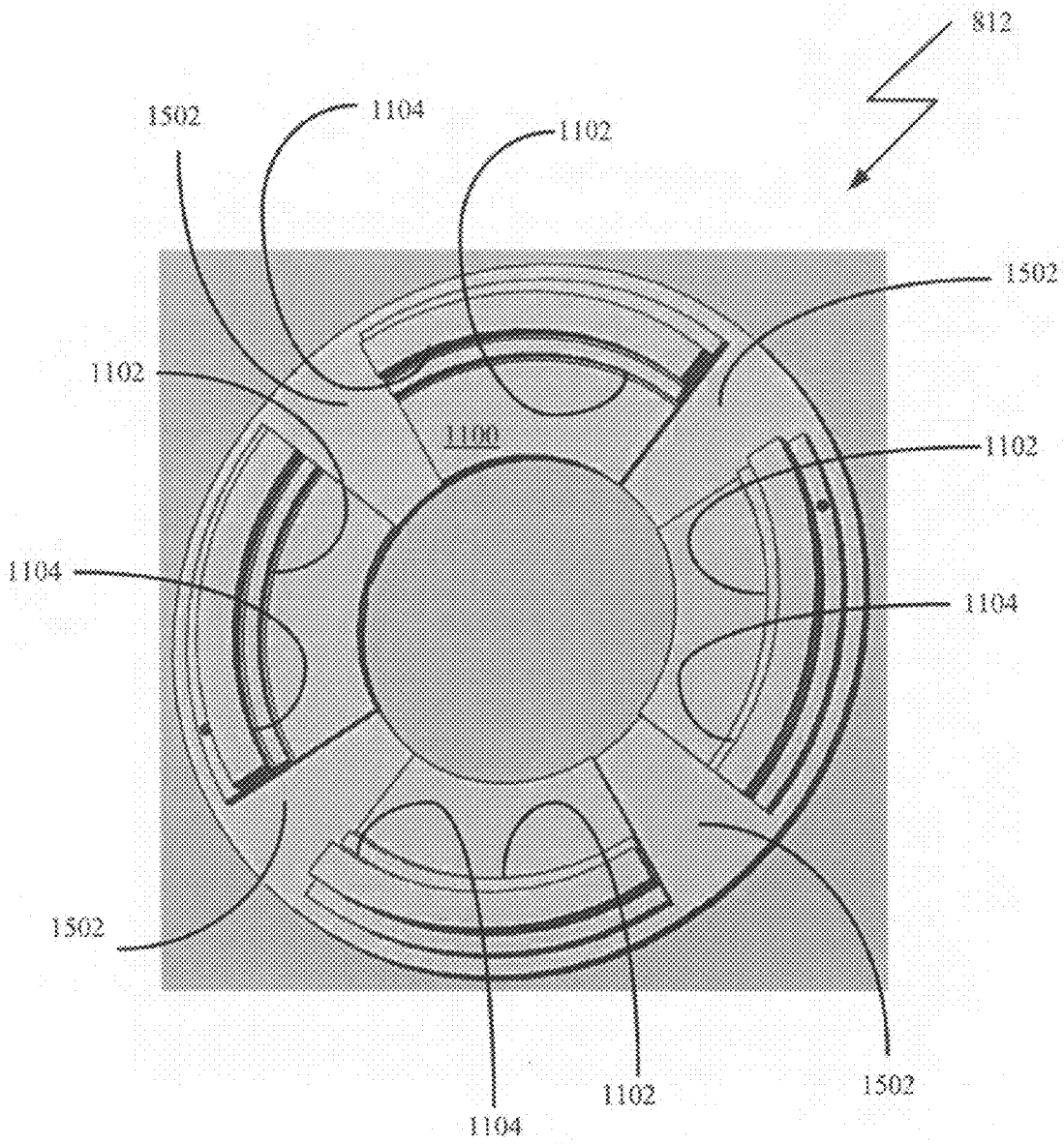
FIG. 15 is a back perspective view of the baffle shown in FIG. 8.

Turning back to the example of an implementation of the loudspeaker transducer 800 shown in FIG. 8, in FIG. 15, a bottom view of the baffle 812 is shown. As described earlier in FIG. 11, the baffle 812 has an underside 1100 that may include the pair of concentric radial surfaces 1102 and 1104 that are configured to complement the diametrical dimensions of the annular outer top plate 842 and annular outer permanent magnet 834, respectively. Additionally, one or more air channels 1502 maybe formed on the underside 1100 of the baffle 812 to provide acoustic venting from the magnetic air gap 1000 to the speaker enclosure (not shown).

In one example of an implementation of the present invention, the overall thickness of the loudspeaker transducer construction may be between 3.5 mm to 4 mm. These loudspeaker transducer dimensions are given by way of example only because one skilled in the art will recognize that the above configuration may be incorporated into speaker systems of various sizes and shapes and is not limited to the dimension described above, but may vary based upon the desired application.

In general, terms such as "coupled to," and "configured for coupling to" and "secured to" (for example, a first component is "coupled to" or "is configured for coupling to" or is "secured to" a second component) are used herein to indicate a structural, functional, mechanical, electrical, signal, optical, magnetic, electromagnetic, ionic or fluidic relationship between two or more components or elements. As such, the fact that one component is said to couple to a second component is not intended to exclude the possibility that additional components may be present between, and/or operatively associated or engaged with, the first and second components.

Although the previous description only illustrates particular examples of various implementations, the invention is not limited to the foregoing illustrative examples. A person skilled in the art is aware that the invention as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A transducer magnet for a low profile loudspeaker transducer having a voice coil, surround suspension member, diaphragm, and top plate, the transducer magnet comprising:

a first magnet assembly including:

an annular outer magnet having an outer perimeter, an outer diameter and an inner diameter, and wherein the inner diameter defines a vacant circular center within the annular outer magnet, a circular inner magnet having a diameter less than the inner diameter of the annular outer magnet, wherein the circular inner magnet is positioned concentrically within the vacant circular center of the annular outer magnet, and wherein the difference in length between the diameter of the circular inner magnet and the inner diameter of annular outer magnet define an annular first magnet assembly air gap, wherein the annular outer magnet includes one or more channels extending inwardly from the outer perimeter of the annular outer magnet to the first magnet assembly air gap, and wherein the first magnet assembly air gap is configured to receive the voice coil and the channels are configured to pass hookup wires from the voice coil to an external device from the transducer magnet.

2. The transducer magnet of claim 1, further including a first magnet central bore positioned at the center of the circular inner magnet.

3. The transducer magnet of claim 2, wherein the annular outer magnet and circular inner magnet are permanent magnets.

4. The transducer magnet of claim 1, wherein the annular outer magnet and circular inner magnet are permanent magnets.

5. The transducer magnet of claim 1, wherein the annular outer magnet is segmented into at least two segmented annular outer magnets, wherein the segmented annular outer magnets each include edges that define at least two channels of the at least one channel.

6. The transducer magnet of claim 5, wherein the annular outer magnet and circular inner magnet are permanent magnets.

7. The transducer magnet of claim 1, wherein the transducer magnet is configured for attachment to the surround suspension member.

8. The transducer magnet of claim 7, further including a top surface of the annular outer magnet that is configured for attachment to an outer edge of the surround suspension member.

* * * * *